US012221791B2

(12) United States Patent
Honore, III

(10) Patent No.: US 12,221,791 B2
(45) Date of Patent: Feb. 11, 2025

(54) MULTI-PURPOSE SCREED DEVICE / EXTERIOR WALL CAVITY VENTILATION SYSTEM

(71) Applicant: Bruce Honore, III, Houston, TX (US)

(72) Inventor: Bruce Honore, III, Houston, TX (US)

(73) Assignee: Bruce Honore, Houston, TX (US)

( * ) Notice: Subject to any disclaimer, the term of this patent is extended or adjusted under 35 U.S.C. 154(b) by 193 days.

(21) Appl. No.: 18/073,431

(22) Filed: Dec. 1, 2022

(65) Prior Publication Data

US 2024/0183168 A1 Jun. 6, 2024

(51) Int. Cl.
*E04F 13/00* (2006.01)
*E04F 13/06* (2006.01)
*E04B 1/70* (2006.01)

(52) U.S. Cl.
CPC ..... *E04F 13/007* (2013.01); *E04F 13/06* (2013.01); *E04B 1/70* (2013.01)

(58) Field of Classification Search
CPC ..... E04B 1/70; E04F 13/06; E04F 13/007
USPC ..... 52/302.1
See application file for complete search history.

(56) References Cited

U.S. PATENT DOCUMENTS 3,568,391 A * 3/1971 Conway ..... E04F 19/061 52/364
5,630,297 A * 5/1997 Rutherford ..... E04B 1/66 52/58
5,836,135 A * 11/1998 Hagan ..... E04F 19/02 52/836
6,298,609 B1 * 10/2001 Bifano ..... E04F 19/02 52/302.3
6,385,932 B1 * 5/2002 Melchiori ..... E04F 13/06 52/302.6
6,470,638 B1 * 10/2002 Larson ..... E04B 1/765 52/302.1
6,647,683 B1 * 11/2003 Thomsen ..... E06B 7/14 52/302.1
7,634,883 B1 * 12/2009 Larson ..... E04F 13/06 52/573.1
8,281,530 B2 * 10/2012 Chaussee ..... E04F 13/0803 52/564
8,578,660 B2 * 11/2013 Nolan ..... E04F 19/0468 52/302.6
8,584,416 B2 * 11/2013 Chenier ..... E04F 13/06 52/573.1
9,366,040 B2 * 6/2016 Singh ..... E04F 19/065
10,196,812 B1 * 2/2019 Duffy ..... E04F 13/007
11,371,239 B2 * 6/2022 Baltz, Jr. ..... E04F 19/061
2003/0177736 A1 * 9/2003 Gatherum ..... E04D 13/1475 52/741.1
2006/0254169 A1 * 11/2006 McFadden ..... E04F 13/06 52/344
2006/0277854 A1 * 12/2006 Egan ..... E04B 1/70 52/302.3

(Continued)

*Primary Examiner* — Paola Agudelo
(74) *Attorney, Agent, or Firm* — NZ CARR LAW OFFICE

(57) ABSTRACT

Embodiments of the represent disclosure provides a multi-purpose screed device suitable to provide draining and/or ventilation at various locations of exterior walls in a building. The multi-purpose screed device is compatible with exterior walls with a rain screen disposed outside a weather-resistant barrier layer. The multi-purpose screed device may use a foundation weep screed, overhang soffit screed, and soffit ventilation.

20 Claims, 11 Drawing Sheets

(56) References Cited

U.S. PATENT DOCUMENTS

| | | | | |
|---|---|---|---|---|
| 2007/0062137 | A1* | 3/2007 | Maylon | E04F 13/06 52/367 |
| 2013/0255171 | A1* | 10/2013 | Rutherford | E04F 13/068 52/287.1 |
| 2017/0254091 | A1* | 9/2017 | Friel | E04F 19/02 |

* cited by examiner

MULTI-PURPOSE SCREED DEVICE / EXTERIOR WALL CAVITY VENTILATION SYSTEM

FIELD

The present disclosure relates to a screed device to use for draining and ventilation of building exterior walls, and methods for making and installing the screed device thereof.

BACKGROUND

In the field of building construction, various screed devices are used to provide draining and/or ventilation between the exterior cladding layers, such as stucco, bricks, and the sheathing, such as plywood walls. For example, foundation weep screed devices are used at the base line or the foundation plate line of exterior walls, soffit weep screed devices may be used at a base line of an overhanging exterior wall, and ventilation screed devices may be used at the top edges of an exterior walls. Some screed devices, such as the foundation weep screed devices, are required by building codes. Other screed devices, such as soffit weep screed devices and ventilation screed devices, may be optional. Conventionally, screed devices installed at different locations have different designs to achieve the particular functions. Using different accessories at different locations of the exterior walls increases complicity of construction. And stocking different screed devices increases construction cost.

Therefore, there is a need for improved screed devices.

SUMMARY

The present disclosure includes a multi-purpose screed device suitable for foundation weep screed devices, soffit ventilation devices, or overhang weep screed devices.

Some embodiments of the present disclosure provides a multi-purpose screed device, comprising a wall cladding section; a plaster support section connected to the wall cladding section at a first edge, wherein a plurality of first opening and a plurality of second openings are formed through the plaster support section, and the plurality of first openings are closer to the first edge than the plurality of second openings; an end ventilation section connected to the plaster support section at a second edge, wherein a plurality of third openings are formed through the end ventilation section; and a guard and gauge section connected to the end ventilation section at a third edge.

Some embodiments provide a method for applying a veneer exterior wall. The method comprises: building a sheathing layer, wherein a lower edge of the sheathing layer is formed on a top surface of a foundation and an upper edge of the sheeting layer contacts a ceiling structure; attaching a first multi-purpose screed device along the lower edge of the sheathing layer, wherein the first multi-purpose screed device comprises: a wall cladding section; a plaster support section connected to the wall cladding section at a first edge, wherein a plurality of first opening and a plurality of second openings are formed through the plaster support section, and the plurality of first openings are closer to the first edge than the plurality of second openings; an end ventilation section connected to the plaster support section at a second edge, wherein a plurality of third openings are formed through the end ventilation section; and a guard and gauge section connected to the end ventilation section at a third edge; attaching a weather-resist barrier (WBR) layer over the sheathing layer and the wall cladding section of the first multi-purpose screed device layer; attaching a rain screen layer over the WBR layer, wherein the rain screen layer aligns with the plurality of first openings in the first multi-purpose screed device; and applying a veneer layer over the rain screen layer, wherein an exterior surface of the veneer layer aligns with the third edge of the first multi-purpose screed device.

Some embodiments provide a multi-purpose screed device, comprising: an elongated body having a cross section profile comprising: a first section; a second section connected to the first section; a third section connected to the second section; and a fourth section connected to the third section, wherein the second, third and fourth section enclosing an inner volume, a gap exists between the second section and the fourth section.

BRIEF DESCRIPTION OF THE DRAWINGS

Embodiments of the present disclosure, briefly summarized above and discussed in greater detail below, can be understood by reference to the illustrative embodiments of the disclosure depicted in the appended drawings. It is to be noted, however, that the appended drawings illustrate only typical embodiments of this disclosure and are therefore not to be considered limiting of its scope, for the disclosure may admit to other equally effective embodiments.

Figure 1A:
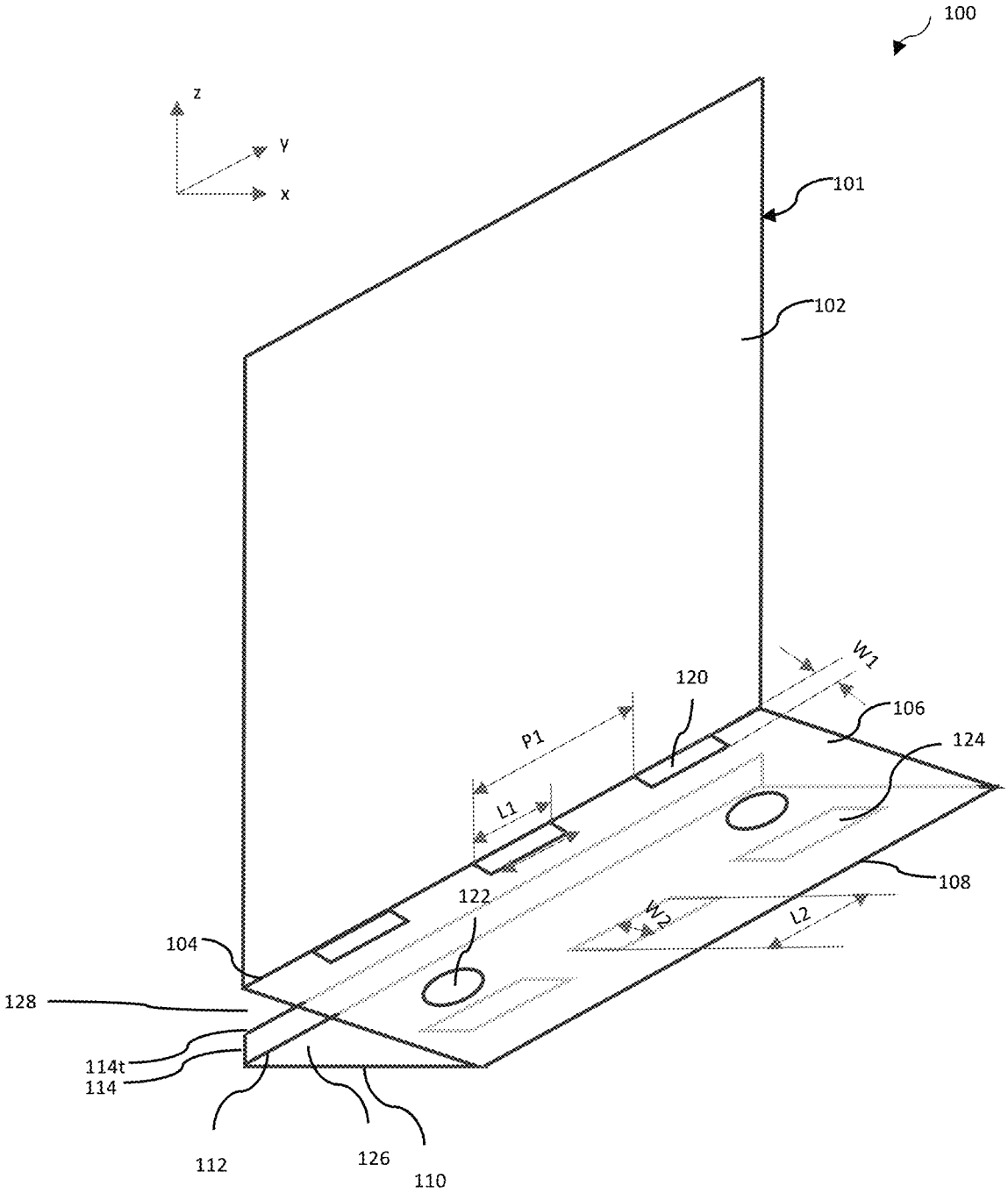
FIG. 1A is a schematic perspective view of a multi-purpose screed device according to embodiments of the present disclosure.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Figure 1B:
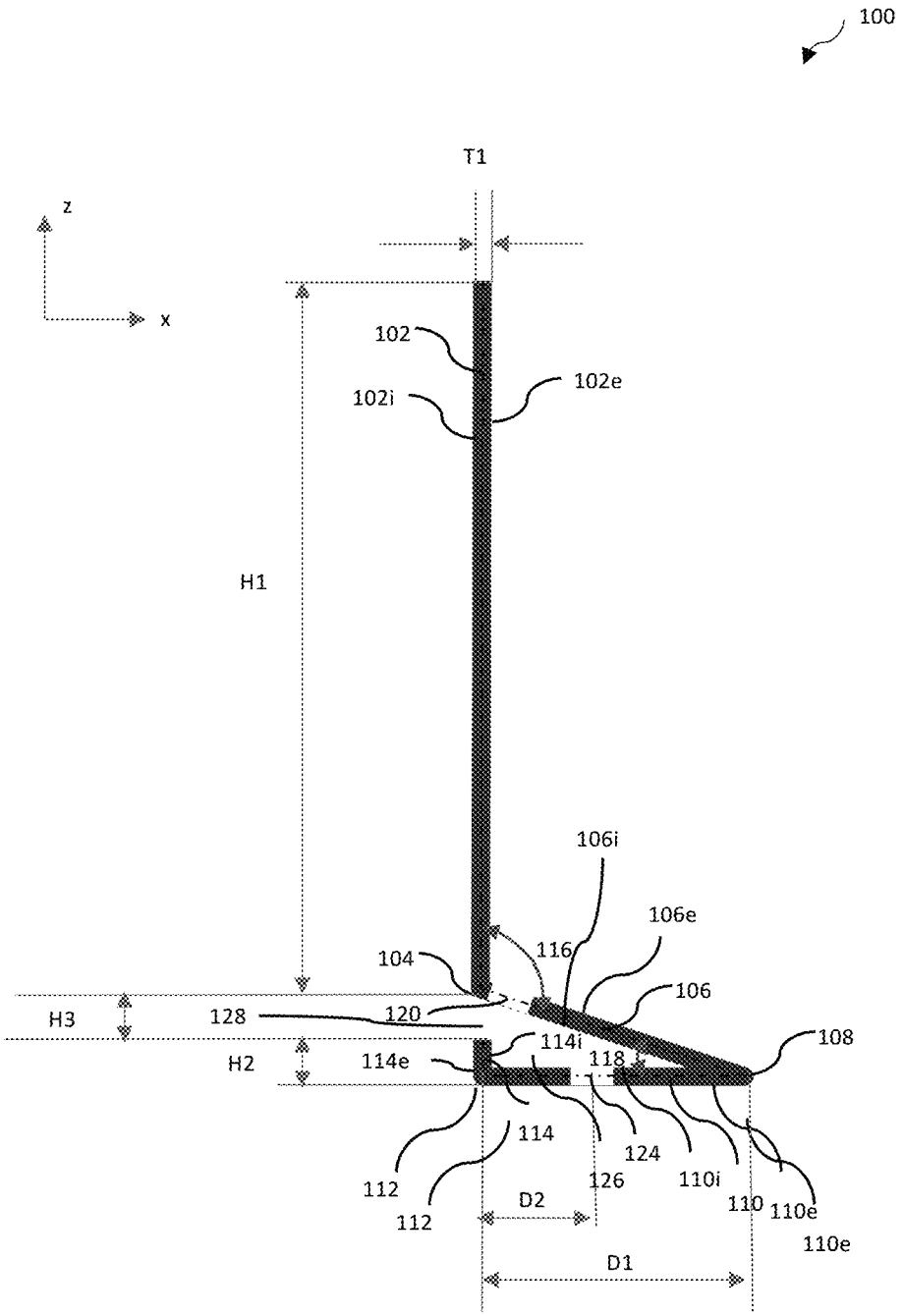
FIG. 1B is a schematic cross-sectional view of the multiple-purpose screed device of FIG. 1A.

FIG. 1A is a schematic perspective view of a multi-purpose screed device 100 according to embodiments of the present disclosure. FIG. 1B is a schematic cross-sectional view of the multiple-purpose screed device 100. As discussed below, the multi-purpose screed device 100 is suitable to provide draining and/or ventilation at various locations of exterior walls in a building.

In some embodiments, the multi-purpose screed device 100 is compatible with exterior walls with a rain screen disposed outside a weather-resistant barrier layer. A rain screen layer is an exterior cladding infrastructure that sits away from a building's outside wall's weather-resistant barrier. The rain screen creates an air cavity directly outside the weather-resistant barrier to help protect the weather-resistant barrier for water or vapor damage. A rain screen layer may have a thickness about a quarter inch. When applying a rain screen layer on an exterior wall, traditional weep screed devices do not accommodate the added thickness of the exterior wall. Installing a traditional weep screed device in an exterior wall with a rain screen would end up with a portion of thin stucco leading to cracking or other damages.

The multi-purpose screed device 100 is an elongated construction article extending along the y-axis in FIGS. 1A-1B. The multi-purpose screed device 100 includes an elongated body 101 having multiple sections. FIG. 1B shows the cross-section of the multi-purpose screed device 100 in a x-z plane. In some embodiments, the multi-purpose screed device 100 may be manufactured in a length between 12 ft to 30 ft along the y-axis.

The multi-purpose screed device 100 is configured to install in an upper edge or a lower edge of an exterior wall. In some embodiments, the multi-purpose screed device 100 includes serially connected planar sections. The planar sections are connected to each other at different angels to form a barrier between interior layers and exterior layers of the wall and provide a vapor exit path for any moister connected in the wall.

In some embodiments, the elongated body 101 has multiple planar sections. In some embodiments, the cross-section of the elongated body 101 has a shape similar to a lowercase letter "b". In some embodiments, the elongated body 101 of the multi-purpose screed device 100 includes a wall cladding section 102, a plaster support section 106, an end ventilation section 110, and a guard and gauge section 114. The wall cladding section 102 and the plaster support section 106 are connected at an edge 104. The plaster support section 106 and the end ventilation section 110 are connected at an edge 108. The end ventilation section 110 and the guard and gauge section 114 are connected at an edge 112. The edges 104, 106, and 112 are substantially parallel to each other, parallel to the y-axis in FIG. 1A.

The wall cladding section 102 is the largest section of the wall cladding section 102, the plaster support section 106, the end ventilation section 110, and the guard and gauge section 114. The wall cladding section 102 is configured to attach to and extended out of an edge of an interior layer so that to direct any moisture away from the interior layer. As shown in FIG. 1A, the wall cladding section 102 has a planar body with an interior surface 102*i* and an exterior surface 102*i* opposing the interior surface 102*i*. When installed, the interior surface 102*i* faces an interior layer, the plywood layer, and the exterior surface 102*p* faces various exterior layers, such as plaster layers of a stucco wall. At the edge 104, the plaster support section 106 bends towards the exterior surface 102*p* to direct the moisture away from the interior layer. The wall cladding section 102 may have a height H1 along the z-axis in FIG. 1B. The height H1 is selected to have enough coverage of the interior layer from the external elements. In some embodiments, the height H1 is in a range between about 2.5 inches and about 6 inches.

The plaster support section 106 extends from the edge 104 at an angle 116 relative to the wall cladding section 102. The plaster support section 106 has an interior surface 106*i* and an exterior surface 106*e* opposing the interior surface 106*i*. In some embodiments, the exterior surface 106*e* is in connection to the exterior surface 102*e* of the wall cladding section 102. The plaster support section 106 is configured to contact and retain exterior wall layers, such as weather resist barrier layers, the rain screen and various plaster layers of a stucco wall. When installed, the exterior surface 106*e* may be in contact with various plaster layers.

A plurality of rain screen openings 120 are formed through the plaster support section 106. The plurality of rain screen openings 120 are through holes connecting the interior surface 106*i* and the exterior surface 106*e*. The plurality of rain screen openings 120 may be formed adjacent to the edge 104. In some embodiments, the plurality of rain screen openings 120 may be formed along the edge 104. When installed, the plurality of rain screen openings 120 are positioned to expose at least a portion of the rain screen so that content, such as water or vapor, may exit the rain screen through the plurality of rain screen openings 120.

In some embodiments, the plurality of rain screen openings 120 may be elongated openings arranged in a line along the edge 104. Each rain screen opening 120 may have a length L1 and a width W1. In some embodiments, the plurality of rain screen openings 120 may be evenly distributed along the edge 104 at a pitch P1. In some embodiments, the pitch P1 is in a range between about 0.5 inch and about 2 inches. The length L1 of each rain screen opening 120 may be in a range between about 0.25 in and 1.5 inch. In some embodiments, a ratio of L1 over P1 may be in a range between about 0.4 and about 0.8. In some embodiments, the width W1 may be substantially similar to a thickness of the rain screen used in the exterior wall. In some embodiments, the width W1 is in a range between about 0.1 inch and about 0.3 inch. The plurality of rain screen openings 120 may be of any suitable shapes, such as circular, triangular, oval, hexagonal shapes. The plurality of rain screen openings 120 may be and arranged in any suitable manner, such as in line, staggered, in an array.

In some embodiments, the plaster support section 106 includes a plurality of plaster anchoring holes 122. The plurality of plaster anchoring holes 122 may be through holes formed between the plurality of rain screen openings 120 and the edge 108. The plaster anchoring holes 122 are positioned to allow a small amount plaster passes therethrough. As the plaster is drying out and hardening, the small amount of plaster in each plaster anchoring hole 122 secures the plaster support section 106 relative to the plaster layers. In some embodiments, each of the plaster anchoring hole 122 may be a circular opening having a diameter in a range between about 0.2 inch and about 0.5 inch.

The plaster support section 106 extends to a distance D1 along the x-axis from the wall cladding section 102, as shown in FIG. 1B. The distance D1 is substantially corresponding to the total thickness of various exterior layers of a wall. In some embodiments, the width is in a range between about 0.5 inch to about 2.0 inch depending on the building design.

In some embodiments, the angle 116 between the wall cladding section 102 and the plaster support section 106 is greater than 90 degrees so that the plaster support section 106 is sloped along a thickness of the wall. Sloping of the plaster support section 106 increases contact areas between the plaster support section 106 and the wall layers, such as the rain screen layer. Sloping of the plaster support section 106 increases exposure of the rain screen layer, thus, improving draining and ventilation. In some embodiments, the angle 116 between the wall cladding section 102 and the plaster support section 106 in a range between about 110 degrees and 130 degrees.

The end ventilation section 110 extends from the edge 108 at an angle 118 relative to the plaster support section 106. In some embodiments, the end ventilation section 110 extends from the edge 108 along the x-axis for a distance substantially the same as the width D2. The end ventilation section 110 has an interior surface 110*i* and an exterior surface 110*e* opposing the interior surface 110*i*. A transition volume 126 is formed between the interior surface 110*i* of the end ventilation section 110 and the interior surface 106*i* of the plaster support section 106. The transition volume 126 provides an air cushion between the wall layers, such as the rain screen layer, disposed over the exterior surface 106*e* of the plaster support section 106. The transition volume 126 may prevent environmental objects, such as particles, dusts, or insects, from entering or clogging the plurality of rain screen openings 120.

A plurality of ventilation openings 124 are formed through the end ventilation section 106. The plurality of rain screen openings 124 are through holes connecting the interior surface 110*i* and the exterior surface 110*e*. The plurality of ventilation openings 124 connect the transition volume 126 to the environment. In some embodiments, the plurality of ventilation openings 124 may be disposed at a distance D2 from the wall cladding section 102 along the y-axis, thus, directing water and vapor away from the interior structure, such as the plywood layer. In some embodiments, the distance D2 may be about 0.5 of the distance D1. In some embodiments, the plurality of ventilation openings 124 may be formed near a central line between the edge 112 and the edge 108.

In some embodiments, in a unit length of the multi-purpose screed device 100, the total area of the plurality of ventilation openings 124 is greater than the total area of the plurality of rain screen openings 120. The greater area of the ventilation openings 124 provides improved drainage and ventilation.

The plurality of ventilation openings 124 may be of any suitable shapes, such as circular, triangular, oval, hexagonal shapes. The plurality of ventilation openings 124 may be and arranged in any suitable manner, such as in line, staggered, in an array. In some embodiments, the plurality of ventilation openings 124 may be arranged to form an ornamental pattern. In some embodiments, the plurality of ventilation openings 124 may be elongated openings, each having a length L2 and a width W2. The length L2 of each ventilation opening 124 may be in a range between about 0.25 in and 1.5 inch. In some embodiments, the width W2 is in a range between about 0.2 inch and about 0.6 inch. In some embodiments, the plurality of ventilation openings 124 may be evenly distributed along the y-axis. In some embodiments, the plurality of ventilation openings 124 may be ranged in the same pitch as the plurality of rain screen openings 120. In other embodiments, the plurality of ventilation openings 124 and the plurality of rain screen openings 120 may be ranged in a staggered manner to prevent foreign objects from clogging the rain screen openings 120.

In some embodiments, the end ventilation section 110 is substantially perpendicular to the wall cladding section 102, so that the angle 118 and the angle 116 are supplementary angles, i.e. the sum of the angel 118 and the angel 116 is 180 degrees.

The guard and gauge section 114 bends at the edge 112 from the end ventilation 110 towards the wall cladding section 102. In some embodiments, the guard and gauge section 114 aligns with the wall cladding section 102. In other words, the guard and gauge section 114 and the wall cladding section 102 are substantially co-planar. In some embodiments, the guard and gauge section 114 is substantially perpendicular to the end ventilation section 110. The guard and gauge section 114 has an interior surface 114*i* and an exterior surface 114*e* opposing the interior surface 114*i*. The interior surface 114*i* faces the transition volume 126. In some embodiments, the exterior surface 114*e* of the guard and gauge section 114 is substantially flash with the interior surface 102*i* of the wall cladding section 102.

In some embodiments, the guard and gauge section 114 may have a height H2. In some embodiments, the height H2 is in a range between 0.125 inch and 0.375 inch, for example about 0.25 inch. A gap 128 may be formed between a tip 114*t* of the guard and gauge section 114 and the edge 104. The gap 128 may have a height H3. In some embodiments, the height H3 may be greater than about 0.2 inches, for example about 0.25 inch.

The guard and gauge section 114 has multiple functions. For example, the guard and gauge section 114 may function as a guard for building structures facing the exterior surfaces 114*e* by preventing any collected water in the transition volume 126 from flowing towards the building structures. In other embodiments, the tip 114*t* of the guard and gauge section 114 may be used as alignment gauge when install the screen device 100 on an overhang or soffit.

When any accessories, such as a cover, is used with the multi-purpose screed device 100, the guard and gauge section 114 may be also used to clip with the accessories. The gap 128 is designed to allow clips from the accessories to enter the transition volume 126 and snap on to the guard and gauge section 114.

The multi-purpose screed device 100 may be formed from any suitable material, such as metal, plastic, or a combination thereof. For example, the multi-purpose screed device 100 may be made of calvinized steel, aluminum, coper, or alloys thereof. The multi-purpose screen device 100 may be manufactured from plastic material, such as polyvinyl chloride (PVC), polyethylene, vinyl, polyurethane, or any suitable material.

In some embodiments, the multi-purpose screed device 100 may be formed by bending a sheet material and the wall cladding section 102, the plaster support section 106, the end ventilation section 110, and the guard and gauge section 114 may have substantially the same thickness. For example, the multi-purpose screed device 100 may be formed from sheet materials of 22, 24, 26, or 28 gauge calvinized steel.

In other embodiments, the wall cladding section 102, the plaster support section 106, the end ventilation section 110, and the guard and gauge section 114 may have different thicknesses according to design. The multi-purpose screed device 100 may be formed by molding, casting, extrusion, or any suitable methods.

As discussed above, the multi-purpose screed device 100 can be used at various locations to provide draining and ventilation. FIGS. 2A-2B, 3A-3B, and 4A-4B provide some examples according to embodiments of the present disclosure.

Figure 2A:
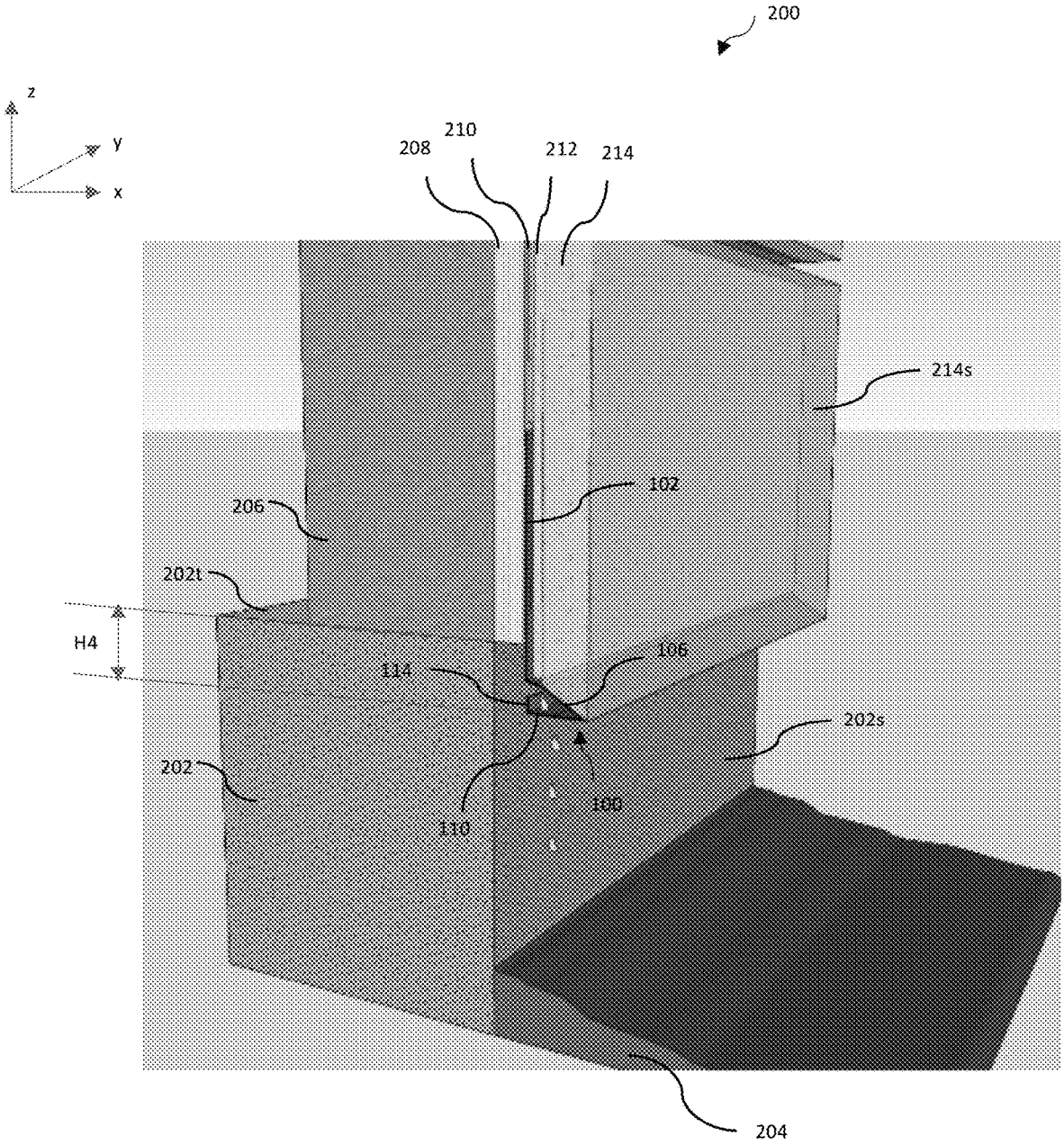
FIG. 2A is a schematic cross-sectional perspective view of an exterior wall at the foundation including the multi-purpose screed device according to the present disclosure.
Figure 2B:
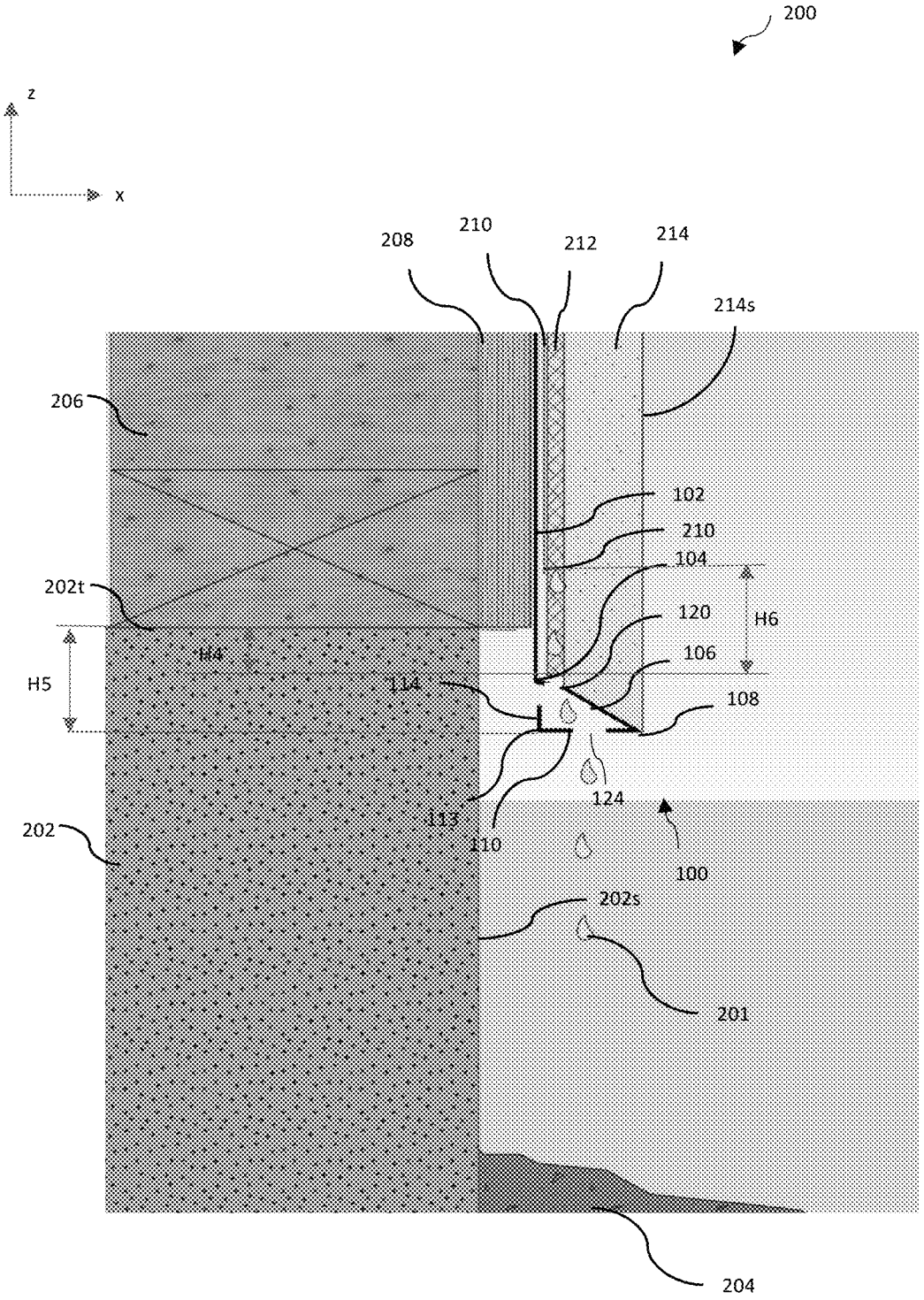
FIG. 2B is a schematic cross-sectional view of the exterior wall of FIG. 2A.

In FIGS. 2A-2B, the multi-purpose screed device 100 is used as a foundation screed to drain an exterior wall near the foundation of a building. FIG. 2A is a schematic cross-sectional perspective view of an exterior wall 200 at the foundation including the multi-purpose screed device 100 according to the present disclosure. FIG. 2B is a schematic cross-sectional view of the exterior wall 200 of FIG. 2A.

The exterior wall 200 is built over a foundation 202. The foundation 202 may be concrete slab formed in and over the ground 204. The foundation 202 has a top surface 202*t* and exterior side surfaces 202*s*. The top surface 202*t* is substantively level to support a building thereon. The exterior side surface 202*s* may be substantially perpendicular to the top surface 202*t*. The top surface 202*t* of the foundation 202 extends above the ground 204 to raise the building above the ground 204. A portion of the exterior side surface 202*s* is exposed above the ground 204.

The exterior wall 200 is formed along the exterior side surface 202*s* of the foundation 202. The exterior wall 200 may be built by raising a plurality of frame members 206. The plurality of framing members 206 may be secured to the top surface 202*t* of the foundation 202. The frame members 206 may be wood or metal studs. A sheathing layer 208 is then attached to the frame member 206. The sheathing layer 208 may be formed from suitable building material, such as plywood. The sheathing layer 208 forms an interior layer of the exterior wall 200. In some embodiments, at least a portion of the sheathing layer 208 extends beyond the exterior side surface 202*s* of the foundation 202. The sheathing layer 208 is formed above the top surface 202*t* of the foundation 202. Various exterior layers are then formed over the sheathing layer 208 to protect the sheathing layer 208 and the frame members 206 from the elements of the environment.

After the interior layers, i.e. the framing members 206 and the sheathing layer 208 are built on the foundation 202, the multi-purpose screed device 100 may be then attached to the sheathing layer 208 along the foundation 202. The multi-purpose screed device 100 may be attached to the sheathing layer 208 by securing the wall cladding section 102 to the sheathing layer 208. In some embodiments, the multi-purpose screed device 100 may be attached to the sheathing layer 208 by nails. Alternatively, the multi-purpose screed section 100 may be attached by any suitable methods, such as by an adhesive, or a combination of nails and adhesive.

As shown in FIGS. 2A-2B, a portion of the wall cladding section 102 of the multi-purpose screed device 100 may extend below the top surface 202*t* of the foundation to ensure that any water collected in the transition volume 126 is directed away from the sheathing layer 208. As shown in FIG. 2B, the edge 104 of the multi-purpose screed device 100 may be positioned at a height H4 below the top surface 202*t* of the foundation 202. In some embodiments, the height H4 may be in a range between about 0 inch and 1.5 inches. The end ventilation section 110 extends at a height H5 from the top surface 202*t* of the foundation 202. The end ventilation section 110 is positioned above the ground 204 so that the ventilation openings 124 are open. In some embodiments, the height H5 may be in a range between about 1 inch and about 2.5 inch.

After the multi-purpose screed device 100 is attached along the foundation 202, a weather-resist barrier (WRB) layer 210 is attached to the sheathing layer 208. The WRB layer 210 may include one or more water-proof fabric material, such as TYVEK® fabrics. The WRB layer 210 may cover the entire surface of the sheathing layer 208 and overlap with the multi-purpose screed device 100. The WRB layer 210 may function as a sealing layer for the interior layers, such as the sheathing layer 208 and the framing members 206. As shown in FIGS. 2A-2B, the WRB layer 210 substantially covers the exterior surface 102*e* of the wall cladding section 102 of the multi-purpose screed device 100. In some embodiments, the WRB layer 210 terminates at a height H6 above the edge 104 to avoid clogging the rain screen openings 120 in the multi-purpose screed device 100. In some embodiments, the height H6 may be in a range between about 0.25 inch and about 1.0 inch. The WRB layer 210 typically has a thickness about 1/16 inch.

After the WRB layer 210 is attached, a rain screen layer 212 is attached to the WRB layer 210. The rain screen layer 212 is a porous siding building material. The rain screen layer 212 includes air cavities, which create a capillary break and to allow drainage and evaporation therethrough. The rain screen layer 212 may be formed from moisture tolerant material and integrated with flashing. The rain screen layer 212 may be selected from commercially available products, such as DRIWALL® rainscreens. The rain screen layer 212 may cover the entire surface of the WRB layer 210 and extend to the edge 104 of the multi-purpose screed device 100.

The multi-purpose screed device 100 provides a flow path to allow water and vapor to be drained from the rain screen layer 212. The rain screen layer 212 may have a thickness in a range between about ⅛ inch and about % inch. The width W1 of the multi-purpose screed device 100 may be selected to accommodate the thickness of the rain screen layer 212. The rain screen openings 120 are sized and positioned to align with the rain screen layer 212.

After the rain screen layer 212 is attached, a veneer layer 214 is formed over the rain screen layer 212 to complete the exterior wall 200. In some embodiments, the veneer layer 214 may be a stucco veneer and include a mesh, a first plaster coat, a second plater coat, and a third stucco coat, sequentially attached to rain screen layer 212. The plaster support section 106 of the multi-purpose screed device 100 functions at a border the lower edge of the veneer layer 214. A mesh layer may be first attached the rain screen layer 212. The mesh layer is configured support the first plaster layer in place while the first plaster layer is wet. The mesh layer may be metal lath and metal wire lath, any other suitable materials. The mesh layer may be secured in place to the sheathing layer 208 through the rain screen layer 212 and the WRB layer 210 by any suitable means, such as staples.

The first plaster coat, commonly referred as a scratch coat, is then applied on the mesh layer. The first plaster coat may have a thickness between about ¼ inch and ½ inch, for example about ⅜ inch. The second plaster coat, commonly known as a brown coat, is then applied on the first plaster coat. The second plaster coat may have a thickness between about ¼ inch and % inch, for example about ⅜ inch. The third plaster coat, commonly known as a finish coat, is then applied on the second plaster coat. The third plaster coat may have a thickness between about 1/16 inch and ¼ inch, for example about ⅛ inch.

The first, second, and third plaster coats terminate at the exterior surface 106*e* of the plaster support section 106 of the multi-purpose screed device 100. In some embodiments, the first, second, and/or third plaster coats may extend through the plaster anchor holes 122 so that the multi-purpose screed device 100 and the veneer layer 214 are fixedly attached to each other. The third paster coat forms an exterior surface 214*s* of the veneer layer 214. In some embodiments, the exterior surface 214*s* of the veneer layer 214 is substantially flush with the edge 108 of the multi-purpose screed device 100.

As shown in FIGS. 2A-2B, water 201 collected in the rain screen layer 212 can be drained from the rain screen layer 212 through the multi-purpose screed device 100 to the ground 204, away from the foundation 202, the framing members 206, and the sheathing layer 208. Particularly, the water 201 in the rain screen layer 212 may flow through the cavities in the rain screen layer 212 to the transition volume 126 of the multi-purpose screen device 100 through the rain screen openings 120, and then exit the transition volume 126 through the end ventilation openings 124. Because the end ventilation openings 124 are located further away from the sheathing layer 208 than the rain screen layer 212, the water 201 is directed away from the foundation 202 and the sheathing layer 208, thus, preventing sheathing layer 208. Similarly, the guard and gauge section 114 also prevents the water 201 accumulated in the transition volume 126 from flowing back to the foundation 202 and the sheathing layer 208.

Figure 3A:
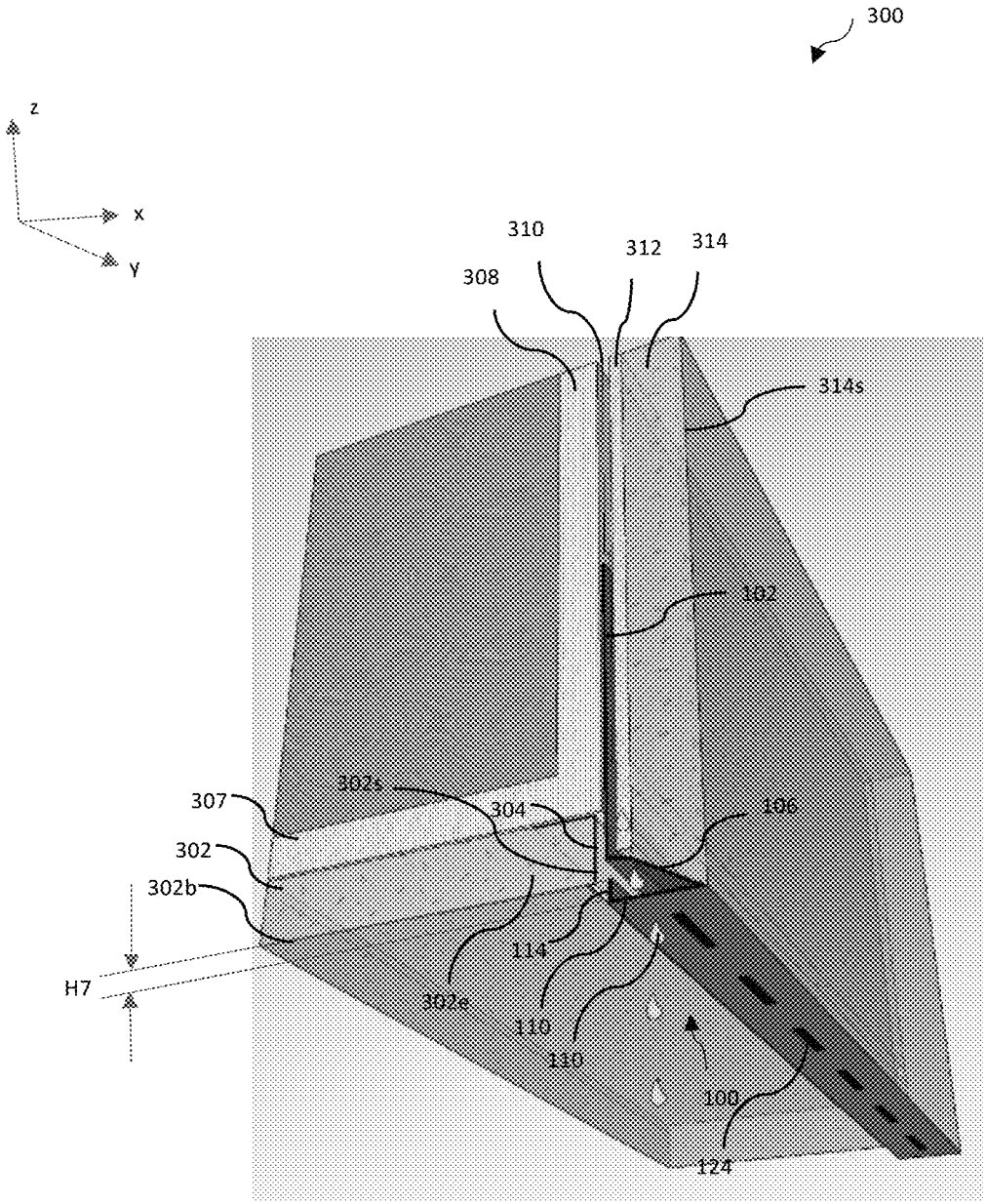
FIG. 3A is a schematic cross-sectional perspective view of an overhang exterior wall including the multi-purpose screed device according to the present disclosure.
Figure 3B:
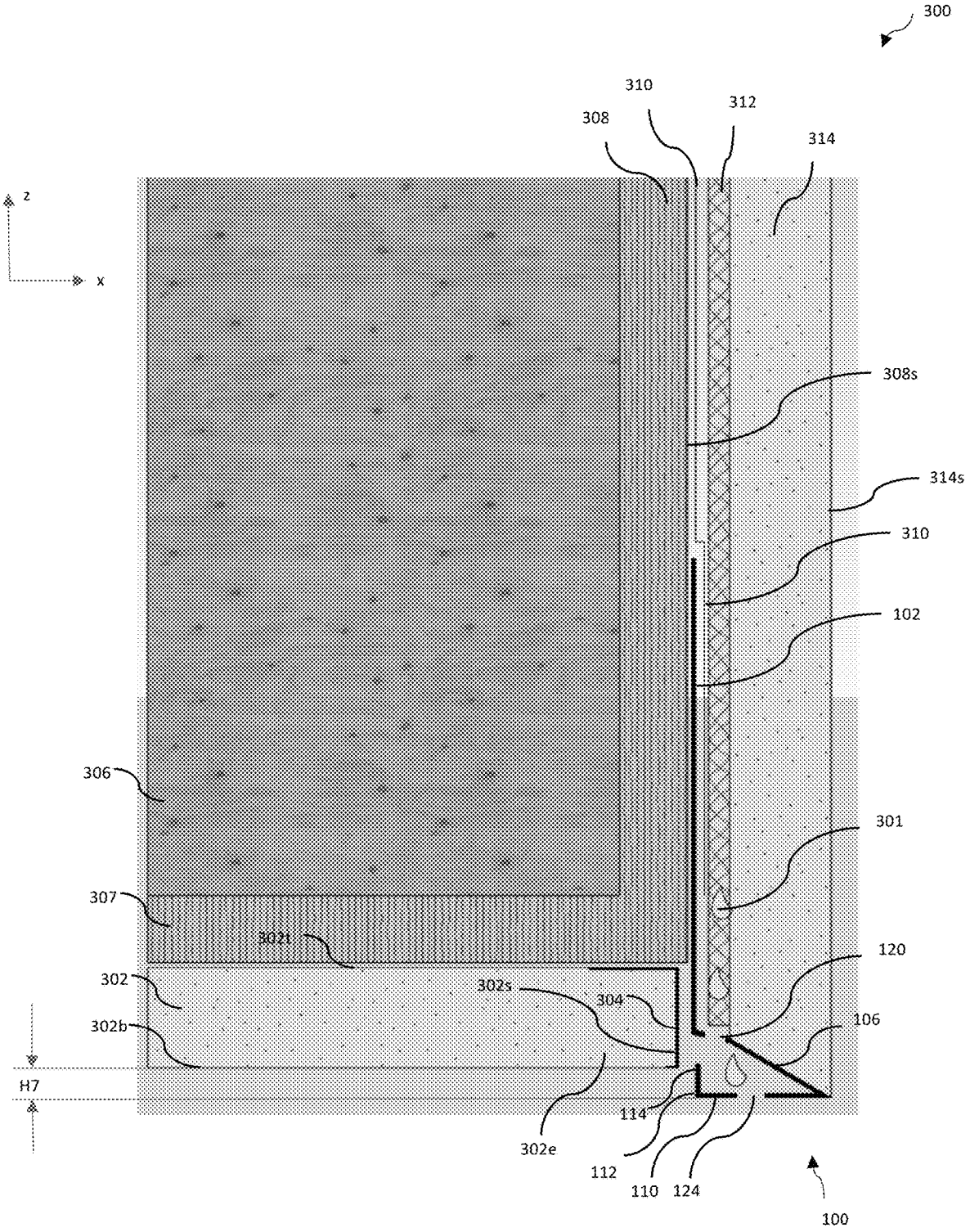
FIG. 3B is a schematic cross-sectional view of the overhang exterior wall of FIG. 3A.

FIG. 3A is a schematic cross-sectional perspective view of an overhang exterior wall 300 including the multi-purpose screed device 100 according to the present disclosure. FIG. 3B is a schematic cross-sectional view of the overhang exterior wall 300 of FIG. 3A. In FIGS. 3A-3B, the multi-purpose screed device 100 is used as an overhang soffit weep. The term "overhang," as used herein, is a broad term, and is used in accordance with its ordinary meaning. The term "overhang" includes, but is not limited to, soffits, corner returns, bay windows, or other building structures that protrude from a building side at a level above foundation. An overhang typically includes a corner where a horizontal veneer wall meets a vertical veneer wall. The multi-purpose screed device 100 according to the present disclosure may be used to provide drainage from vertical portions of veneer wall at overhang structures.

The exterior wall 300 is built over an overhang structure, which includes framing members 304, a horizontal sheathing 307 and a vertical sheathing 308 built over the framing members 304. The vertical sheathing 308 extends upward from the horizontal sheathing 307 forming an overhang structure.

A soffit veneer 302 may be first built outside the horizontal sheathing 307. The soffit veneer 302 may be built from any suitable exterior material and by any methods available to persons skilled in the art. In the example of FIGS. 3A-3B, the soffit veneer 302 includes a stucco layer. The soffit veneer 302 may have a bottom surface **302*b* and a side surface 302*s*. In some embodiments, the side surface 302*s* of the soffit veneer 302 may be aligned with or slightly pulled back from a side surface 308*s* of the vertical sheathing 308. In some embodiments, a cover 304 may be attached to the side surface 302*s* to protect the soffit veneer 302 from water or moisture drippings. In some embodiments, the cover 304 may be a water proof sheet material. The cover 304 may wrap around an end portion 302*e* of the soffit veneer 302**.

As shown in FIGS. 3A-3B, at least a portion of the vertical sheathing layer 308 extends beyond the side surface **302*s* of the soffit veneer 302. After the interior layers, i.e. the framing members 306, the vertical sheathing layer 308, and the soffit veneer 302 are built, the multi-purpose screed device 100 may be then attached to the vertical sheathing layer 308. The multi-purpose screed device 100 may be attached to the vertical sheathing layer 308 by securing the wall cladding section 102 to the vertical sheathing layer 308. In some embodiments, the multi-purpose screed device 100 may be attached to the vertical sheathing layer 308 by nails. Alternatively, the multi-purpose screed section 100** may be attached by any suitable methods, such as by an adhesive, or a combination of nails and adhesive.

Similar to in the exterior wall 200, a portion of the wall cladding section 102 of the multi-purpose screed device 100 may extend below a top surface **302*t* of the soffit veneer 302 so that any water collected in the transition volume 126 is directed away from the horizontal sheathing layer 307 and the vertical sheathing layer 308. Additionally, as shown in FIGS. 3A-3B, a portion of the multi-purpose screed device 100 may extend below the bottom surface 302*b* of the soffit veneer 302 so that any water collected in the transition volume 126 is directed away from the soffit veneer 302. As shown in FIG. 3B, the edge 112 of the multi-purpose screed device 100 may be positioned at a height H7 below the bottom surface 302*b* of the soffit veneer 302. In some embodiments, the height H7 may be in a range between about ¼ inch and 1.0 inch. In some embodiments, the tip 114*t* of the guard and gauge section 114 may be used as a gauge during installation. For example, the tip 114*t* of the gauge section 114 may be aligned with the bottom surface 302*b* of the soffit veneer 302**.

After the multi-purpose screed device 100 is attached to the vertical sheathing layer 308, a weather-resist barrier (WRB) layer 310 is attached to the vertical sheathing layer 308. The WRB layer 310 may include one or more waterproof fabric material, such as TYVEK® fabrics. The WRB layer 310 may cover the entire surface of the vertical sheathing layer 308 and overlap with the multi-purpose screed device 100. The WRB layer 310 may function as a sealing layer for the interior layers, such as the vertical sheathing layer 308 and the framing members 306. As shown in FIGS. 3A-3B, the WRB layer 310 substantially covers the exterior surface **102*e* of the wall cladding section 102 of the multi-purpose screed device 100. In some embodiments, the WRB layer 310 terminates at between about 0.25 inch and about 1.0 inch above the edge 104 to avoid clogging the rain screen openings 120 in the multi-purpose screed device 100**.

After the WRB layer 310 is attached, a rain screen layer 312 is attached to the WRB layer 310. The rain screen layer 312 is a porous siding building material. The rain screen layer 312 includes air cavities, which create a capillary break and to allow drainage and evaporation therethrough. The rain screen layer 312 may be formed from moisture tolerant material and integrated with flashing. The rain screen layer 312 may be selected from commercially available products, such as DRIWALL® rainscreens. The rain screen layer 312 may cover the entire surface of the WRB layer 310 and extend to the edge 104 of the multi-purpose screed device 100.

The multi-purpose screed device 100 provides a flow path to allow water and vapor to be drained from the rain screen layer 312. The rain screen layer 312 may have a thickness in a range between about ⅛ inch and about % inch. The width W1 of the multi-purpose screed device 100 may be selected to accommodate the thickness of the rain screen layer 312. The rain screen openings 120 are sized and positioned to align with the rain screen layer 312.

After the rain screen layer 312 is attached, a vertical veneer layer 314 is formed over the rain screen layer 312 to complete the exterior wall 300. In some embodiments, the vertical veneer layer 314 may be a stucco veneer and constructed in a manner similar to the veering layer 214.

As shown in FIGS. 3A-3B, water 301 collected in the rain screen layer 312 can be drained from the rain screen layer 312 through the multi-purpose screed device 100 to the space below, away from the horizontal veneer layer 302, the framing members 306, the horizontal sheathing layer 307, and the vertical sheathing layer 308. Particularly, the water 301 in the rain screen layer 312 may flow through the cavities in the rain screen layer 312 to the transition volume 126 of the multi-purpose screen device 100 through the rain screen openings 120, and then exit the transition volume 126 through the end ventilation openings 124. Because the end ventilation openings 124 are located further away from the vertical sheathing layer 308 than the rain screen layer 312, the water 301 is horizontal veneer layer 302, the framing members 306, the horizontal sheathing layer 307, and the vertical sheathing layer 308. Similarly, the guard and gauge section 114 also prevents the water 301 accumulated in the transition volume 126 from flowing back to the horizontal veneer layer 302 and the horizontal sheathing layer 307.

Figure 4A:
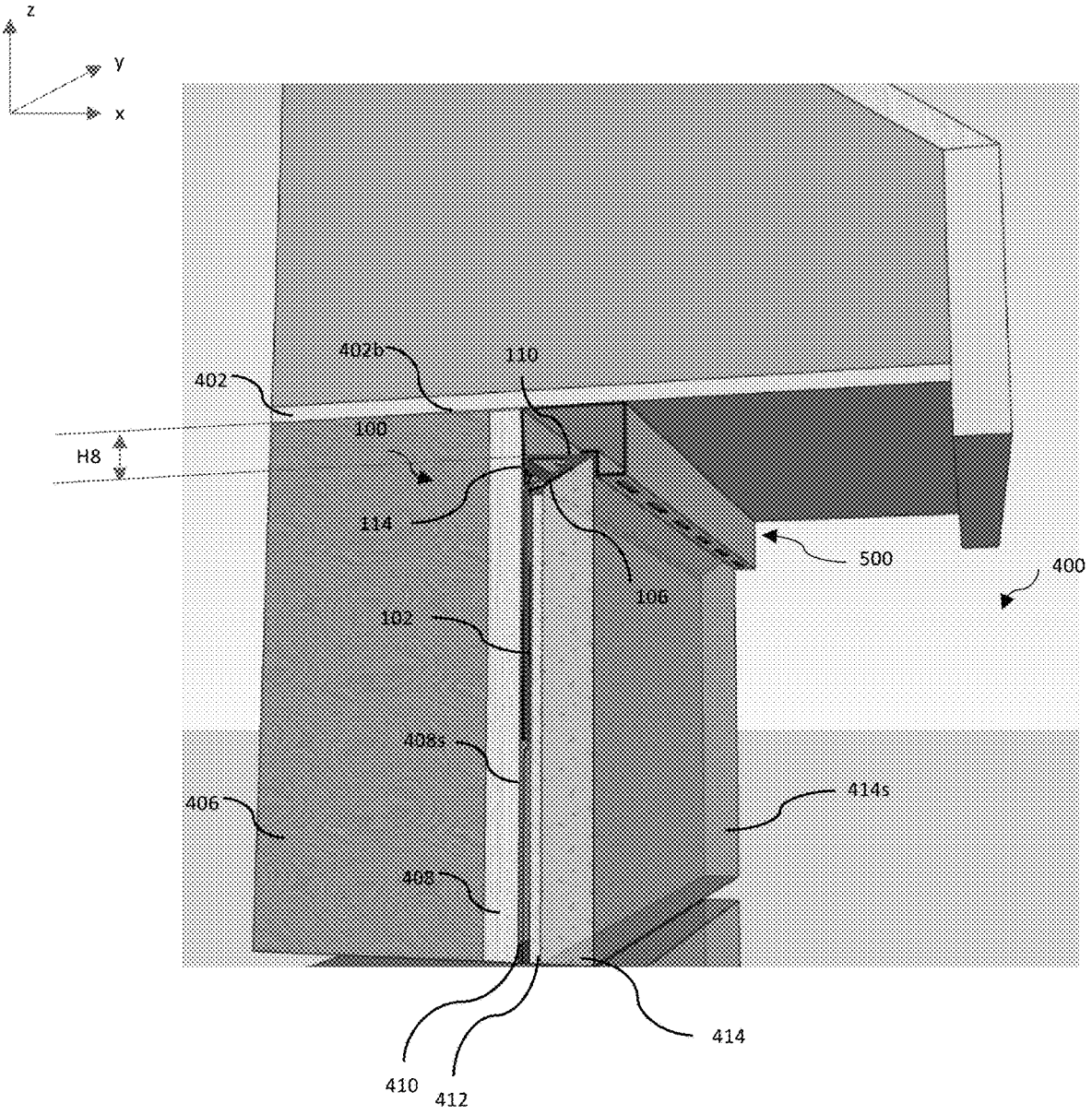
FIG. 4A is a schematic cross-sectional perspective view of an exterior wall at ceiling soffit including the multi-purpose screed device according to the present disclosure.
Figure 4B:
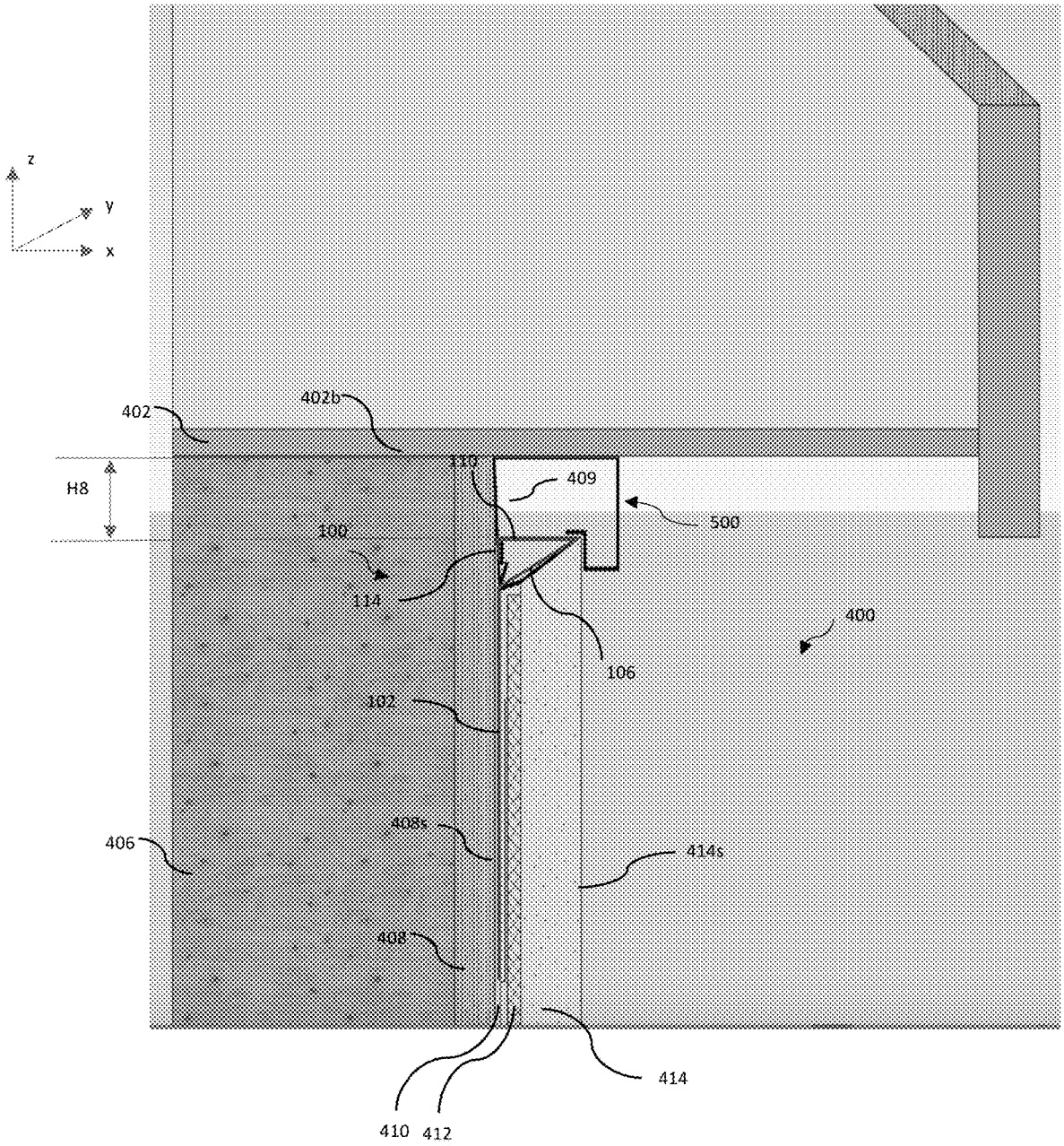
FIG. 4B is a schematic cross-sectional view of the exterior wall of FIG. 4A.

FIG. 4A is a schematic cross-sectional perspective view of an exterior wall 400 at ceiling soffit including the multi-purpose screed device 100 according to the present disclosure. FIG. 4B is a schematic cross-sectional view of the exterior wall 400 of FIG. 4A. The multi-purpose screed device 100 is used to provide ventilation at an upper edge of the exterior wall 400.

FIGS. 4A and 4B schematically illustrate an upper portion of the exterior wall 400, which may be built under a ceiling member 402 of a building. In some embodiments, the exterior wall 400 and the exterior wall 200 or the exterior wall 300 may be the same exterior wall which includes the multi-purpose screed device 100 on the lower edge, i.e. above the foundation or soffit veneer, and the upper edge, i.e. under the ceiling. The multi-purpose screed device 100 at the lower edge provides drainage while the multi-purpose screed device 100 at the upper edge provide ventilation from top to bottom, thus improving drying rate.

As shown in FIGS. 4A-4B, interior structures, such as framing members 406, and a sheathing layer 408 are built under a ceiling structure 402. In some embodiments, the framing members 406 and the sheathing layer 408 are secured to a bottom surface 402*b* of the ceiling structure 402.

As shown in FIGS. 4A-4B, the multi-purpose screed device 100 is attached to an exterior surface 408*s* of the sheathing layer 408 with the end ventilation section 110 facing the bottom surface 402*b* of the ceiling structure 402. The multi-purpose screed device 100 may be attached to the sheathing layer 408 by securing the wall cladding section 102 to the sheathing layer 408. In some embodiments, the multi-purpose screed device 100 may be attached to the sheathing layer 408 by nails. Alternatively, the multi-purpose screed section 100 may be attached by any suitable methods, such as by an adhesive, or a combination of nails and adhesive.

In some embodiments, the multi-purpose screed device 100 is positioned to leave a gap 409 between the end ventilation section 110 and the ceiling structure 402. The gap 409 provides a space for ventilation passage. In some embodiments, a cover may be installed in the gap 409 to provide protection for the exposed sheathing layer 408 and to form an outward flow path. The gap 409 may have with a height H8. In some embodiments, the height H8 is in a range between about % inch and 2.0 inch. The height H8 is selected to allow installation of the cover.

After the multi-purpose screed device 100 is attached to the sheathing layer 408, a weather-resist barrier (WRB) layer 410 is attached to the sheathing layer 408. The WRB layer 410 may include one or more water-proof fabric material, such as TYVEK® fabrics. The WRB layer 410 may cover the sheathing layer 408 and overlap with the multi-purpose screed device 100. The WRB layer 410 may function as a sealing layer for the interior layers, such as the sheathing layer 408 and the framing members 406. In some embodiments, the WRB layer 410 terminates at between about 0.25 inch and about 1.0 inch below the edge 104 to avoid clogging the rain screen openings 120 in the multi-purpose screed device 100.

After the WRB layer 410 is attached, a rain screen layer 412 is attached to the WRB layer 410. The rain screen layer 412 is a porous siding building material. The rain screen layer 412 includes air cavities, which create a capillary break and to allow drainage and evaporation therethrough. The rain screen layer 312 may be formed from moisture tolerant material and integrated with flashing. The rain screen layer 412 may cover the entire surface of the WRB layer 410 and extend to the edge 104 of the multi-purpose screed device 100.

The multi-purpose screed device 100 provides a ventilation path to allow water and vapor to be drained from the rain screen layer 412. The rain screen layer 412 may have a thickness in a range between about ⅛ inch and about % inch. The width W1 of the multi-purpose screed device 100 may be selected to accommodate the thickness of the rain screen layer 412. The rain screen openings 120 are sized and positioned to align with the rain screen layer 412.

After the rain screen layer 412 is attached, a veneer layer 414 is formed over the rain screen layer 412 to complete the exterior wall 400. In some embodiments, the vertical veneer layer 414 may be a stucco veneer and constructed in a manner similar to the veering layer 214.

As shown in FIGS. 4A-4B, the multi-purpose screed device 100 provides an upper cover to the WRB layer 410, the rain screen 412, and the veneer layer 414, and a ventilation path. Particularly, the cavities in the rain screen layer 312 are in fluid communication with external environment through the rain screen openings 120, the transition volume 126, the end ventilation openings 124 of the multi-purpose screed device 100.

Figure 5A:
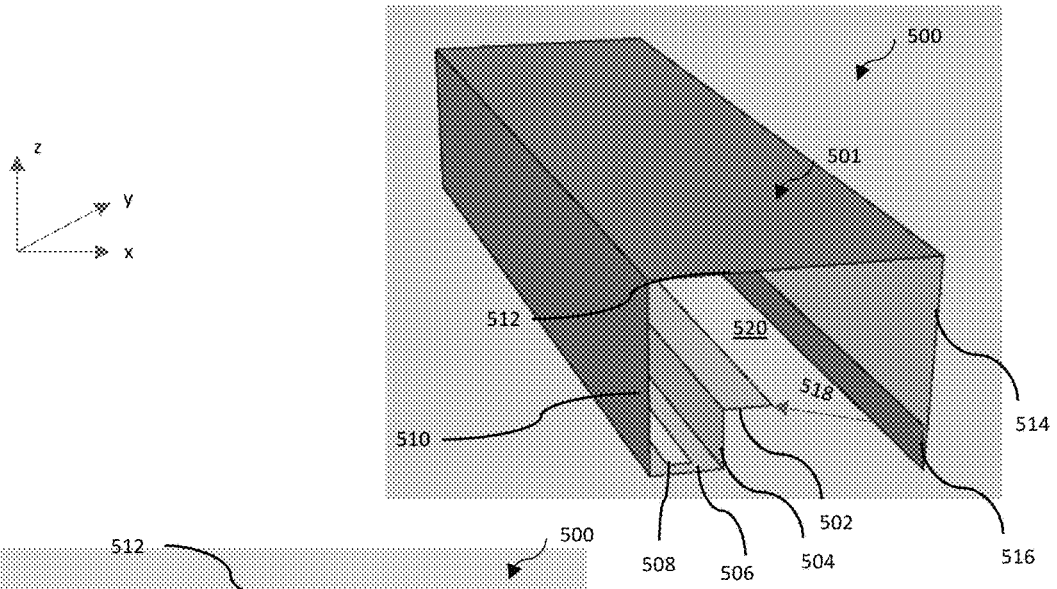
FIGS. 5A and 5B are schematic perspective view of a clip-on cover for a soffit ventilation according to embodiments of the present disclosure.
Figure 5B:
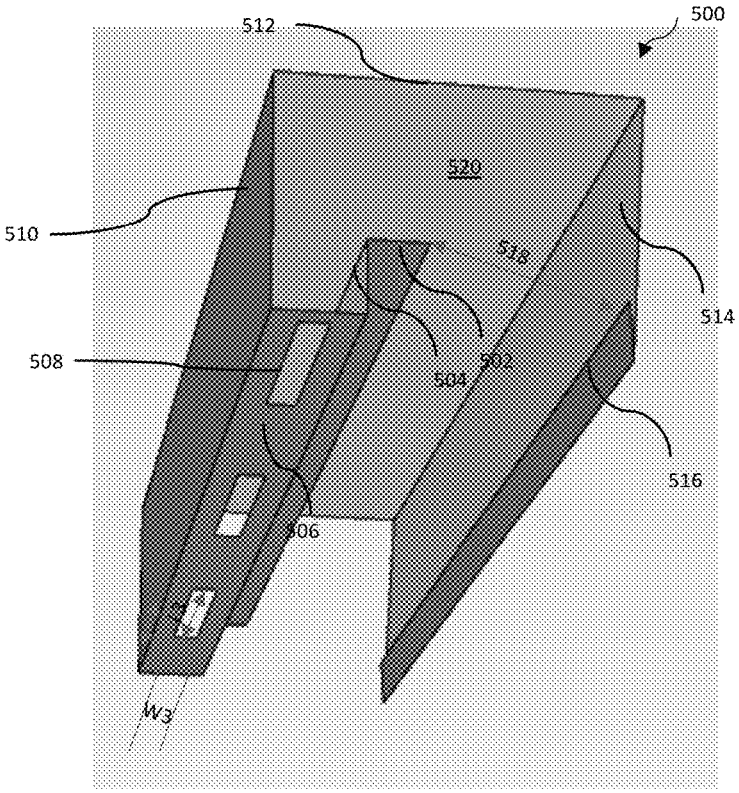
Figure 5C:
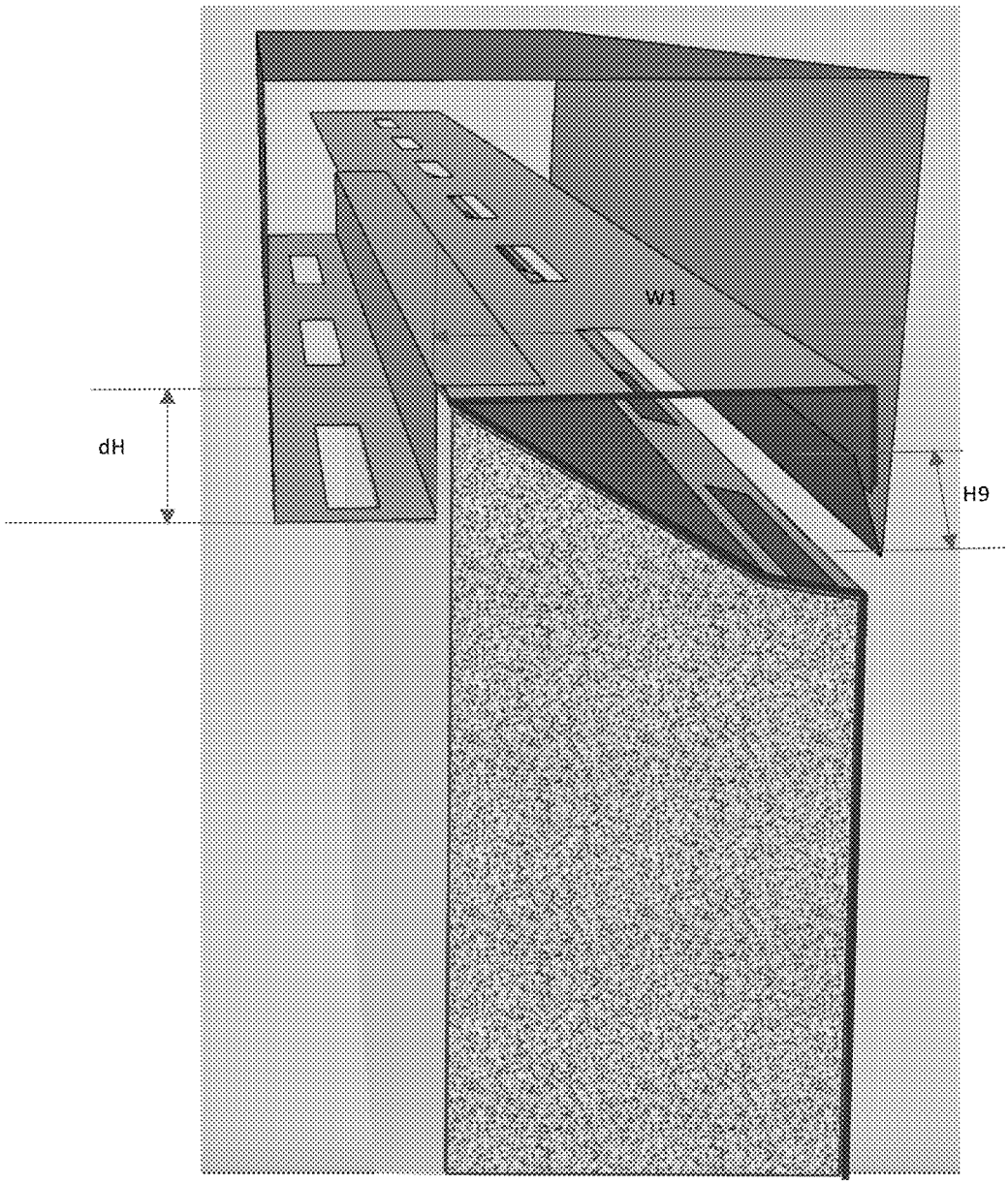
FIG. 5C is a schematic cross-sectional view of the clip-on cover installed on the multi-purpose screed device according to the present disclosure.

In some embodiments, a clip-on cover 500 may be installed in the gap 409 to provide protection for the exposed sheathing layer 408 and to extend the outward flow path from the end ventilation openings 124. FIGS. 5A and 5B are schematic perspective view of the clip-on cover 500 for a soffit ventilation according to embodiments of the present disclosure. FIG. 5C is a schematic cross-sectional view of the clip-on cover 500 installed on the multi-purpose screed device 100 according to the present disclosure. The The clip-on cover 500 is an elongated construction article extending along the y-axis. In some embodiments, the clip-on cover 500 may be manufactured in a length between 12 ft to 30 ft along the y-axis. The clip-on cover 500 may be configured to use with a ventilation device, such as the multi-purpose screed device 100. In some embodiments, the multi-purpose screed device 100 includes serially connected planar sections. The planar sections are connected to each other at different angels to form a barrier between interior layers and exterior layers of the wall and provide a vapor exit path for any moister connected in the wall.

In some embodiments, the clip-on cover 500 includes an elongated body 501. The elongated body 501 encircles an inner volume 520 with an elongated gap 518. A plurality of openings 508 are formed through the elongated body 501 to connect the inner volume 520 with the external environment. When installed, the elongated gap 518 is configured to connect the inner volume 520 with an upper opening in an exterior wall between the interior layers and the veneer layers. For example, the elongated gap 518 is configured to connect with the end ventilation openings 126 in the exterior wall 400. Cavities in a wall may be ventilated through the gap 518, the inner volume 520 and the plurality of openings 508 of the clip-on cover 500.

In some embodiments, the elongated body 501 may be formed from a sheet material by bending the sheet material to various sections. In the example of FIGS. 5A-5B, the elongated body 501 includes a hanging section 502 configured to hang over an upper edge of a wall structure, and a clipping section 516 configured to clip-on and secure the elongated body 501 to the wall structure. Various other sections may be shaped between the hanging section 502 and the clipping section 516 to enclose the inner volume 520 therein. For example, sections 504, 506, 510, 512, 514 are consecutive shaped between the clipping section 516 and the hanging section 502. The inner volume 520 is shaped to occupy a gap above the wall ventilation openings, such as the gap 409 above the multi-purpose screed device 100 in FIG. 4A.

In some embodiments, the inner volume 520 is shaped to have the plurality of openings 508 at a level below the hanging section 502, therefore, to direct the ventilation flow path downwards. In some embodiments, the hanging section 502 is configured to rest on the end ventilation section 110 of the multi-purpose screed device 100. The plurality of openings 508 are formed through the section 506. The section 506 is connected to the hanging section 502 by the section 504 and is substantially parallel to the hanging section 502. In some embodiments, the hanging section 502 and the section 508 may have a height difference dH in a range between about % A inch and about 1 inch. The sections 510, 512, and 514 enclose a substantially rectangular area. In some embodiments, the distance between the sections 504 and 514 is substantially similar to the width W1 of the multi-purpose screed device 100 so that the multi-purpose screed device 100 is snuggly fitted in the clip-on cover 500.

The clipping section 516 may be bend inwardly from the section 514. In some embodiments, the clipping section 516 has a height H9. In some embodiments, the height H9 may be in a range between about % A inch and above % inch. When installed, the clipping section 516 may hook around the guard and gauge section 114 of the multi-purpose screed device 100 to secure thereon.

The plurality of openings 508 are through holes formed through the section 506. The plurality of openings 508 may be of any suitable shapes, such as circular, triangular, oval, hexagonal shapes. The plurality of openings 508 may be and arranged in any suitable manner, such as in line, staggered, in an array. In some embodiments, the plurality of openings 508 may be arranged to form an ornamental pattern. In some embodiments, the plurality of openings 508 may be elongated openings, each having a length L3 and a width W3. The length L3 of each opening 508 may be in a range between about 0.25 in and 1.5 inch. In some embodiments, the width W3 is in a range between about 0.2 inch and about 0.6 inch.

Figure 6A:
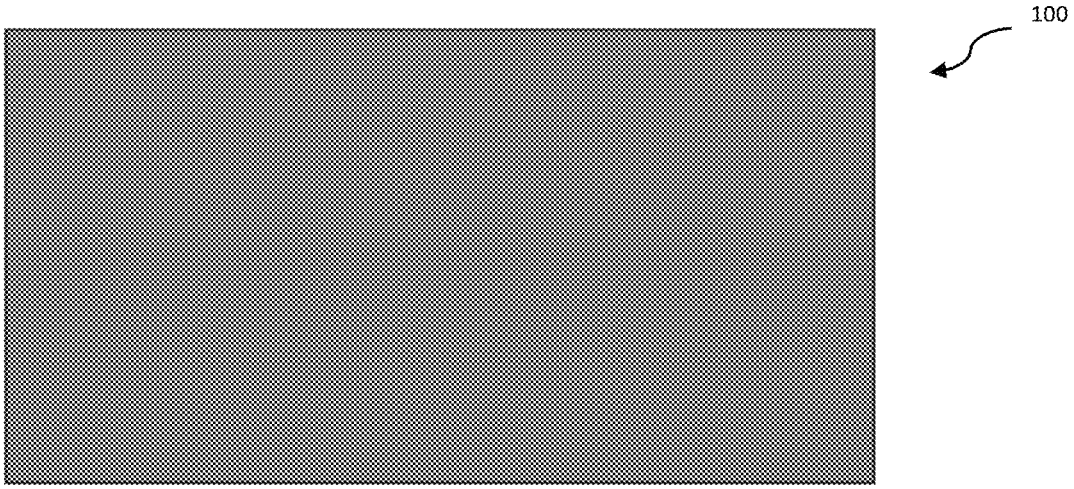
FIGS. 6A-6B are schematic views showing various stages of fabricating the multi-purpose screed device according to the present disclosure.
Figure 6B:
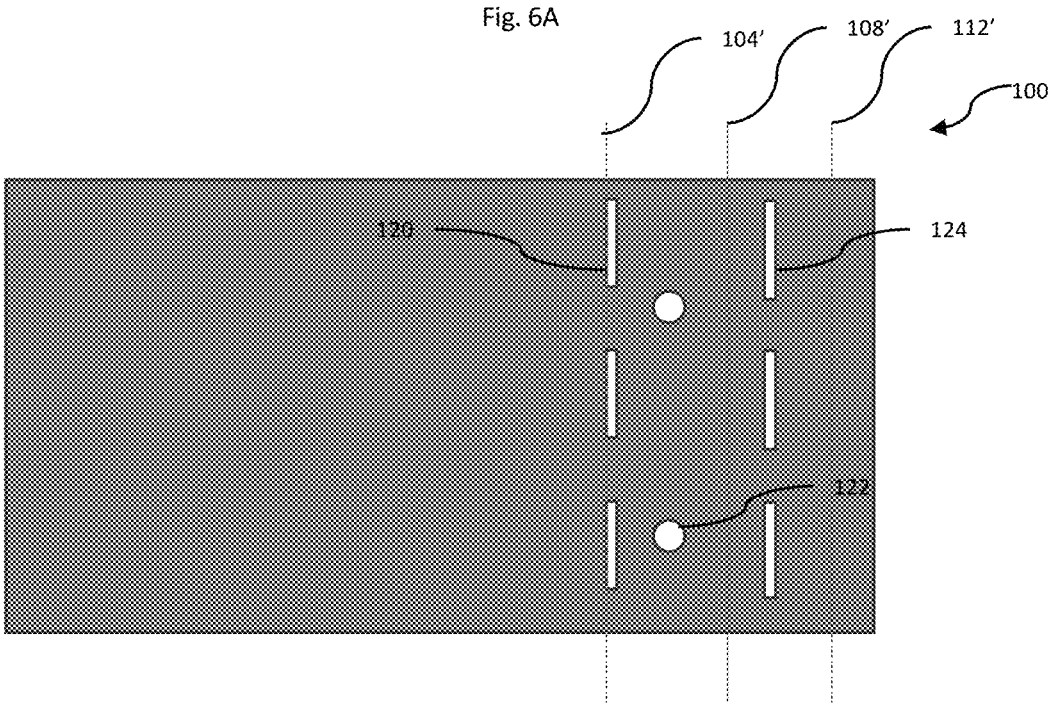

FIGS. 6A-6B are schematic views of the multi-purpose screed device 100 during various stage of fabrication according to the present disclosure. As discussed above, the multi-purpose screed device 100 may be formed from a sheet material, as shown in FIG. 6A. The plurality of opening 120, 122, and 124 are then formed through the sheet material, as shown in FIG. 6B. The sheet material is then folded along lines 104', 108', and 112' to complete the fabrication.

While the foregoing is directed to embodiments of the present disclosure, other and further embodiments of the disclosure may be devised without departing from the basic scope thereof.

The invention claimed is:

1. A multi-purpose screed device, comprising:

a wall cladding section;

a plaster support section connected to the wall cladding section at a first edge, wherein a plurality of first opening and a plurality of second openings are formed through the plaster support section, and the plurality of first openings are closer to the first edge than the plurality of second openings;

an end ventilation section connected to the plaster support section at a second edge, wherein a plurality of third openings are formed through the end ventilation section; and a guard and gauge section connected to the end ventilation section at a third edge, wherein a tip of the guard and gauge section faces the first edge, and a gap is formed between the tip of the guard and gauge section and the first edge.

2. The multi-purpose screed device of claim 1, wherein the wall cladding section and the guard and gauge section are substantially co-planar.

3. The multi-purpose screed device of claim 2, wherein the end ventilation section is substantially perpendicular to the wall cladding section.

4. The multi-purpose screed device of claim 1, wherein the plurality of first openings are formed along the first edge.

5. The multi-purpose screed device of claim 4, wherein the plurality of second openings are formed along a central line between the second edge and third edge.

6. The multi-purpose screed device of claim 1, wherein the wall cladding section, the plaster supporting section, the end ventilation section, and the guard and gauge section are formed by bending a sheet material along the first edge, the second edge, and the third edge.

7. The multi-purpose screed device of claim 6, wherein the wall cladding section and the plaster supporting section form an angle greater than 90 degrees.

8. The multi-purpose screed device of claim 7, wherein the wall cladding section and the plaster supporting section form an angle in a range between 110 degrees and 130 degrees.

9. The multi-purpose screed device of claim 1, wherein the plaster support section, the end ventilation section and the guard and gauge section enclose a transition volume, and the guard and gauge section prevents any collected water in the transition volume flowing towards a building structure.

10. The multi-purpose screed device of claim 9, wherein the plaster support section is configured to attach both an upper portion and a lower portion of an exterior wall, when the plaster support section is attached to the upper portion of the exterior wall, the guard and gauge section is positioned to receive a clip-on cover.

11. The multi-purpose screed device of claim 1, wherein the guard and gauge section is sized to function as an alignment gauge during installation.

12. A multi-purpose screed device, comprising:

an elongated body having a cross section profile comprising:

a first section;

a second section connected to the first section;

a third section connected to the second section; and a fourth section connected to the third section, wherein the second, third and fourth section enclosing an inner volume, a gap exists between the second section and the fourth section, wherein the first section and the fourth section are coplanar, and the gap is located between a tip of the fourth section and an edge connecting the first and second sections, wherein a plurality of first openings are formed through the second section along the edge connecting the first and second section, and a plurality of second openings are formed through the third sections.

13. The multi-purpose screed device of claim 12, wherein the plurality of first openings and the plurality of second openings are staggered.

14. The multi-purpose screed device of claim 12, wherein a width of the plurality of first openings is in a range between about 0.1 inch and about 0.3 inch.

15. The multi-purpose screed device of claim 12, wherein the plurality of the first openings and the plurality of the second openings have the same pitch.

16. The multi-purpose screed device of claim 12, wherein the first section and the second section form an angle in a range between 110 degrees and 130 degrees.

17. The multi-purpose screed device of claim 12, wherein the second section includes a plurality of third openings formed through a central region of the second section.

18. The multi-purpose screed device of claim 17, wherein the plurality of third openings are circular openings having a diameter in a range between about 0.2 inch and about 0.5 inch.

19. The multi-purpose screed device of claim 12, wherein the plurality of first opening has a smaller pitch than the plurality of third openings.

20. The multi-purpose screed device of claim 12, wherein the gap is greater than 0.2 inch.

* * * * *